US006260507B1

(12) United States Patent
Simpson et al.

(10) Patent No.: US 6,260,507 B1
(45) Date of Patent: Jul. 17, 2001

(54) REFLECTING COLLAR ATTACHMENT FOR FIRE HYDRANTS

(76) Inventors: Jeffrey K. Simpson, 108 1/2 Holston View Dr., Bristol, TN (US) 37620; Timothy A. Carty, 2799 Oxen Rd. NE., Waverly, KS (US) 66871

( * ) Notice: Subject to any disclaimer, the term of this patent is extended or adjusted under 35 U.S.C. 154(b) by 0 days.

(21) Appl. No.: 09/039,633

(22) Filed: Mar. 16, 1998

(51) Int. Cl.[7] ..... E03B 9/06

(52) U.S. Cl. ..... 116/200; 116/209; 116/264

(58) Field of Search ..... 116/200, 209, 116/280, DIG. 11, 202, 264, DIG. 41; D10/109, 111; 137/296

(56) References Cited

U.S. PATENT DOCUMENTS

| | | | | |
|---|---|---|---|---|
| D. 336,262 | * | 6/1993 | O'Neal | D10/111 |
| 2,059,009 | * | 10/1936 | McCarthy | 116/200 |
| 2,345,621 | * | 4/1944 | Mothershead | 254/401 |
| 3,561,394 | * | 2/1971 | Pickens | 116/35 R |
| 4,092,948 | | 6/1978 | Bray | 116/309 |
| 4,478,169 | | 10/1984 | Shrefler | 116/209 |
| 4,699,838 | * | 10/1987 | Gilbert | 428/201 |
| 4,727,900 | * | 3/1988 | Dooling et al. | 137/296 |
| 4,827,969 | * | 5/1989 | Lyasko | 137/296 |
| 5,029,550 | * | 7/1991 | Hopper, Sr. et al. | 116/209 |
| 5,178,185 | | 1/1993 | Stehling et al. | 137/543 |
| 5,803,110 | * | 9/1998 | Segal | 137/68.14 |

* cited by examiner

*Primary Examiner*—Andrew H. Hirshfeld
*Assistant Examiner*—R A Smith

(57) ABSTRACT

A reflective collar attachment which is designed to be attached around the periphery of an existing fire hydrant includes mating semi-circular halves, each of which has formed therewith a pair of integral semi-circular extensions with a number of circular stair-stepped indentations of incrementally decreasing radii. Each half of the collar can be adjusted in inner radius by severing the semi-circular extensions at any of the indentations so that the collar can be adjusted to fit any fire hydrant design. Other embodiments include a collar attachment of three piece construction and a resilient strip with projecting top and bottom teeth which can fit any fire hydrant design or shape. A removable reflective tape web is positioned in a display area positioned around the periphery of any of the collar attachments.

8 Claims, 3 Drawing Sheets

REFLECTING COLLAR ATTACHMENT FOR FIRE HYDRANTS

FIELD OF THE INVENTION

The present invention relates to a changeable reflective attachment for fire hydrants, and, more particularly, to a two-piece collar which encircles a connecting flange of a fire hydrant and which includes a display area which receives and displays a web of color coded reflective material. The color coded reflective material can be easily changed to indicate the NFPA standard code for the flow rating of the particular fire hydrant upon which the collar is installed.

BACKGROUND OF THE INVENTION

The fire protection system in most cities in the United States and many foreign countries relies on an extensive network of fire hydrants which are conveniently located and which are attached to high volume, high pressure water supply lines. Fire hydrants are made by a number of different manufacturers in a number of different sizes and capacities. Most fire hydrants in use are constructed with a cast iron outer housing. It is common in the United States to mark fire hydrants according to a color code representing water flow capacity under standards developed by the National Fire Protection Association (NFPA) standard #291, i.e. light blue for Class AA—1500+ gallons per minute (G.P.M.) flow; green for Class A—1000–1499 G.P.M; orange for Class B—500–999 G.P.M.; and red for Class C—0–499 G.P.M. Typically, color coding is accomplished by simply painting the tops and nozzle caps of each fire hydrant housing with the appropriate color, preferably with reflective paint.

A number of problems are associated with the current practices of color coding fire hydrants. For one, weathering of paint applied to the fire hydrants causes a major maintenance problem for cities and municipalities. As paint, including reflective paint, weathers, the colors fade, making the fire hydrants more difficult to see, particularly in low light conditions. As water supply capabilities and capacities change, it is common for a hydrant flow rating to change as well. Many cities have fire safety codes which require their hydrants to be periodically tested to make sure they are in working order and that they are properly flow rated. With conventional color painting schemes, this means that, as flow capacities change, portions of each affected fire hydrant should be repainted to reflect its current flow rating. Due to the difficulty and expense involved in repainting, it is common for fire hydrants to be improperly color coded. Finally, even freshly painted fire hydrants are difficult to spot at night, particularly in poorly lighted neighborhoods. The ability to quickly spot and hook up to a fire hydrant is critical for fire fighters in minimizing property damage and potential loss of life.

One example of an attachment intended to improve visibility of a fire hydrant is evidenced in U.S. Design Pat. No. Des 336,262 to Virgil O'Neal, entitled REFLECTIVE BAND FOR MOUNTING ON A FIRE HYDRANT. The O'Neal design patent shows a circular band, which is, presumably, at least partially reflective, with an adjustable opening and threaded closure which allows it to be clamped to the perimeter of a fire hydrant housing. The band illustrated in the O'Neal patent is very limited in adjustability of the internal diameter and is not color coded for flow rating or changeable in color to reflect differing or changing flow ratings.

It is clear, then, that a need exists for an improved attachment for fire hydrants which makes them highly visible, even at night, which can be quickly and conveniently installed on a wide variety of hydrant sizes and designs, and which is easily and economically changeable in color to reflect different, or changed flow ratings for a given hydrant.

SUMMARY OF THE INVENTION

The present invention is a reflective collar attachment which is designed to be attached around the periphery of an existing fire hydrant. In a first embodiment, the collar is a two piece construction, including a pair of semi-circular halves which attach to each other via mating pins and receptacles. Each half has formed therewith a pair of integral semi-circular extensions, each constructed with a number of semi-circular stair-stepped indentations of incrementally decreasing radii with the smallest circular indentation ending in a semi-circular opening of a minimum radius. Each half of the collar can be adjusted in inner radius by severing the semi-circular extensions at any of the indentations so that the collar can be adjusted to fit any fire hydrant connecting flange. The semi-circular extensions diverge from each other as they extend inward from the perimeter of the collar to prevent moisture from accumulating on the top of the collar. Each half of the collar includes upper and lower flanges separated by a display area which, when the collar is assembled, forms a cylinder which accommodates a web of color coded, highly reflective tape.

In a second embodiment, the collar is similar in appearance to the first embodiment, but has a three piece construction with a cap formed by a cylindrical perimeter wall and an integrally formed top including a circular extension which is also constructed with a number of circular stair-stepped indentations of incrementally decreasing radii with the smallest circular indentation ending in a circular opening of a minimum radius. The cap top can be adjusted in inner radius by severing the circular extensions at any of the indentations so that the collar attachment cap can be adjusted to fit over any circular fire hydrant design. A pair of semi-circular extensions are designed to be snapped or screwed into place against the bottom inside periphery of the cylindrical wall of the cap after it is placed over a fire hydrant connecting flange. Each of the semi-circular extensions also includes a plurality of semi-circular stair-stepped indentations of incrementally decreasing radii with the smallest circular indentation ending in a semi-circular opening of a minimum radius. Each of the semi-circular extensions can thus also be adjusted in inner radius by severing them at any of the indentations so that the bottom of the collar can be adjusted to fit the particular fire hydrant design. As in the first embodiment, the top of the collar is sloped from inside to outside to prevent moisture from accumulating. The cap includes upper and lower flanges on the perimeter wall which are separated by a display area which forms a cylinder which accommodates a web of color coded, highly reflective tape.

In a third embodiment designed to fit hydrants of any shape, a collar includes a continuous, resilient strip of plastic with a plurality of upper and lower tooth-like projections extending outward from the plastic strip with the overall effect creating a channel with a width sized to encompass the vertical dimension of a connecting flange of a fire hydrant. Between each pair of teeth the plastic strip has a vertical indentation which forms a score line such that the strip can be easily severed at the score lines to form any desired length. The strip is then wrapped around a fire hydrant with the teeth extending inward over the top and bottom, respectively, of a fire hydrant flange. Opposing ends of the strip are then overlapped and taped into place with a strong "lock" tape. A web of color coded, highly reflective tape is then placed over the outside of the wrapped strip.

In all three embodiments, the color coded reflective tape web can be easily changed to indicate the particular NFPA standard code for the flow rating of the particular fire hydrant upon which the collar is installed.

OBJECTS AND ADVANTAGES OF THE INVENTION

The objects and advantages of the invention include: providing a reflective collar attachment for fire hydrants; providing such a collar attachment which can be conveniently installed on any fire hydrant; providing such a collar attachment which can be varied in inside diameter to allow installation on any diameter of fire hydrant; providing such a collar attachment which includes a display area which accommodates a web of color coded, reflective tape; providing such a collar attachment which improves visibility of any fire hydrant on which it is installed; providing such a collar attachment which allows the flow rate color coding of a fire hydrant to be quickly and conveniently changed; and providing such a collar attachment which is particularly well suited for its intended purpose.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
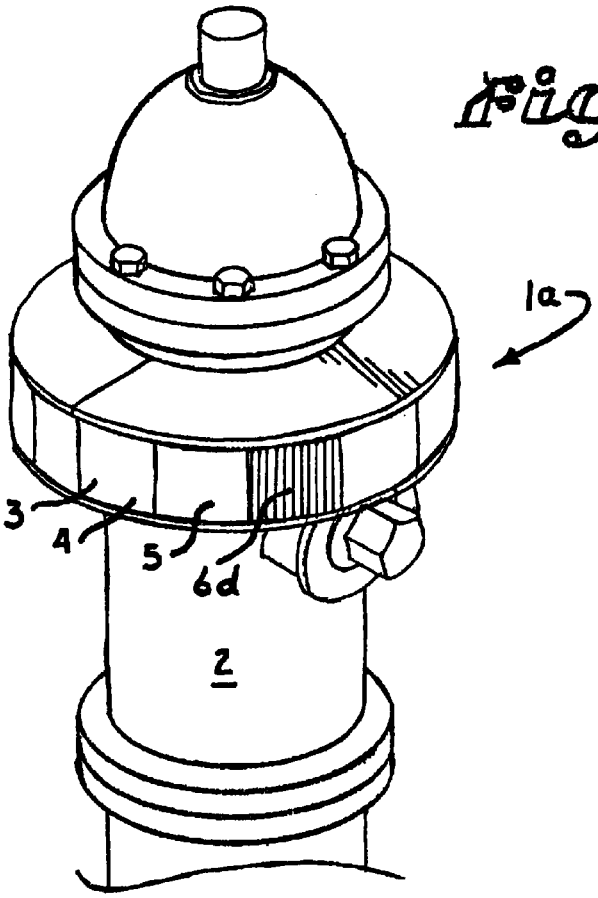
FIG. 1 is a perspective view of a fire hydrant equipped with a reflective collar attachment in accordance with first and second embodiments of the present invention.
Figure 2:
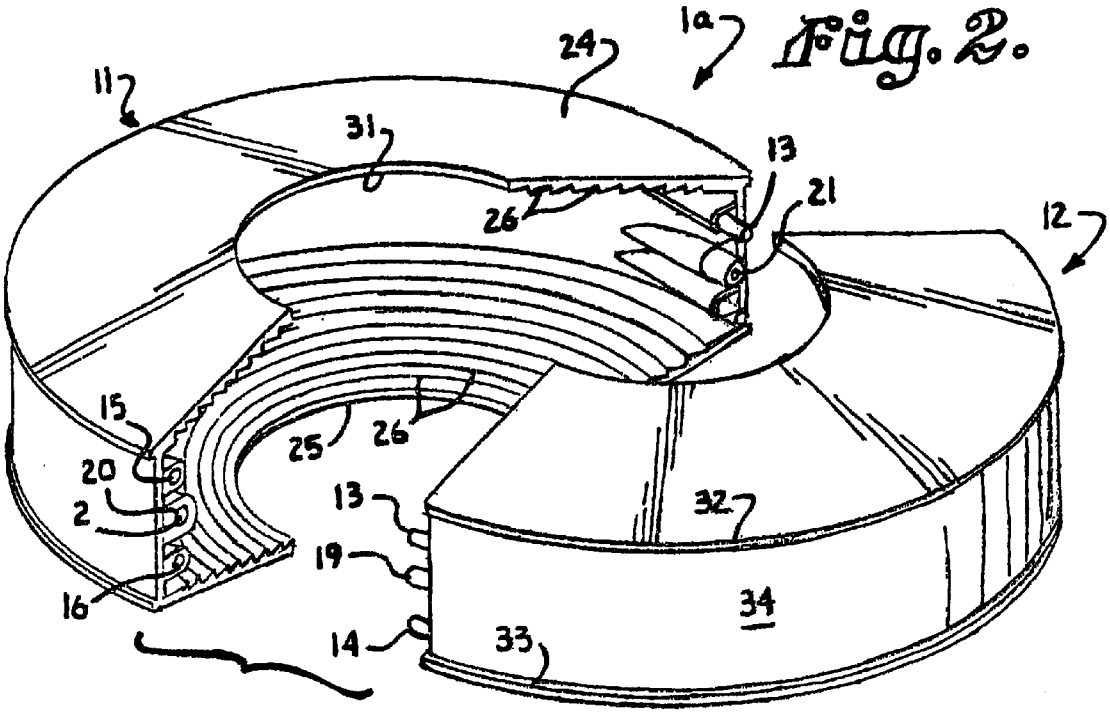
FIG. 2 is an enlarged exploded, perspective view of a first embodiment of the inventive reflective collar prior to installation on the fire hydrant.

Referring to the drawings, and particularly FIG. 1, a first embodiment of reflective collar attachment in accordance with the present invention is generally indicated at 1*a*. FIG. 1 shows the collar attachment 1*a* attached about an upper peripheral portion of a fire hydrant 2 with a reflective web 3 of alternating color bands 4 and 5 positioned around the collar attachment 1. FIG. 2 is an exploded view of the collar attachment 1*a*, including two semi-circular halves 11 and 12 which are essentially mirror images of each other and which attach to each other on either side thereof via alignment pins 13 and 14 which mate with respective receptacles 15 and 16, and an attachment pin 19 which mates with a respective receptacle 20. The attachment pin 19 includes a centered, threaded bore 21 which is positioned and sized to receive a threaded screw (not shown) inserted through a bore 23 in the receptacle 20.

Each semi-circular half 11 and 12 has formed therewith upper and lower semi-circular extensions 24 and 25, respectively, each constructed with a number of semi-circular stair-stepped indentations 26 of incrementally decreasing radii with the smallest circular indentation 26 ending in a semi-circular opening 31 of a minimum radius. Each half 11 and 12 of the collar attachment 1*a* can be adjusted in inner radius by severing the semi-circular extensions 24 and 25 at any of the indentations 26 so that the collar attachment 1*a* can be adjusted to fit fire hydrants of virtually any design or diameter.

As shown in FIGS. 1 and 2, the semi-circular extensions 24 and 25 diverge from each other as they extend inward from the perimeter of the collar 1 to provide a sloping surface which allows water to drain off of the top of the collar 1 to prevent moisture from accumulating on the top of the collar 1. Each half 11 and 12 of the collar 1 includes upper and lower flanges 32 and 33, respectively, separated by a display area 34 which, when the halves 11 and 12 of the collar 1 are assembled, forms a cylinder which accommodates the web 3 of color coded, highly reflective tape. The color coded reflective tape web 3 can be easily changed to indicate the particular NFPA standard code for the flow rating of the particular fire hydrant upon which the collar 1 is installed. For example, FIGS. 6*a*–6*d* show four possible tape designs for the tape web 3, labeled 3*a*–3*d*, with varying patterns which are color coded to match the NFPA codes. The tape design 3*a* is alternating yellow diagonals on a white background, the tape design 3*b* is alternating blue circles on a white background, the tape design 3*c* is alternating green triangles on a white background, and the tape design 3*d* is alternating red and white.

Figure 3:
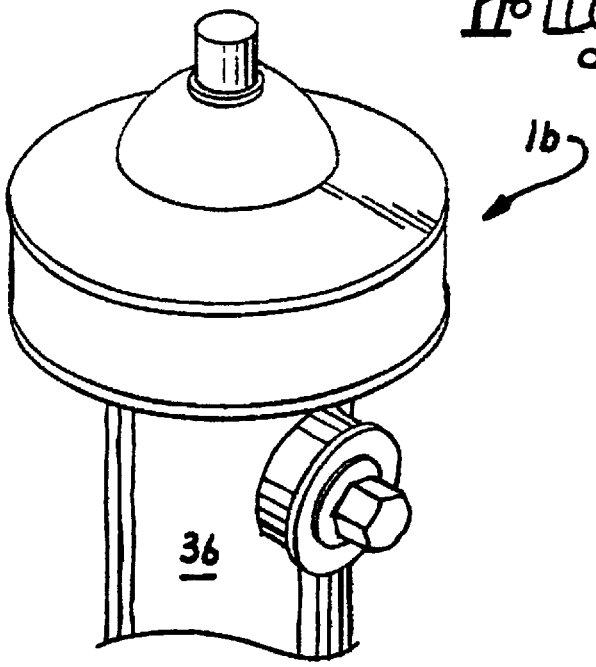
FIG. 3 is a perspective view of a fire hydrant equipped with a reflective collar attachment in accordance with a second embodiment of the present invention.
Figure 4:
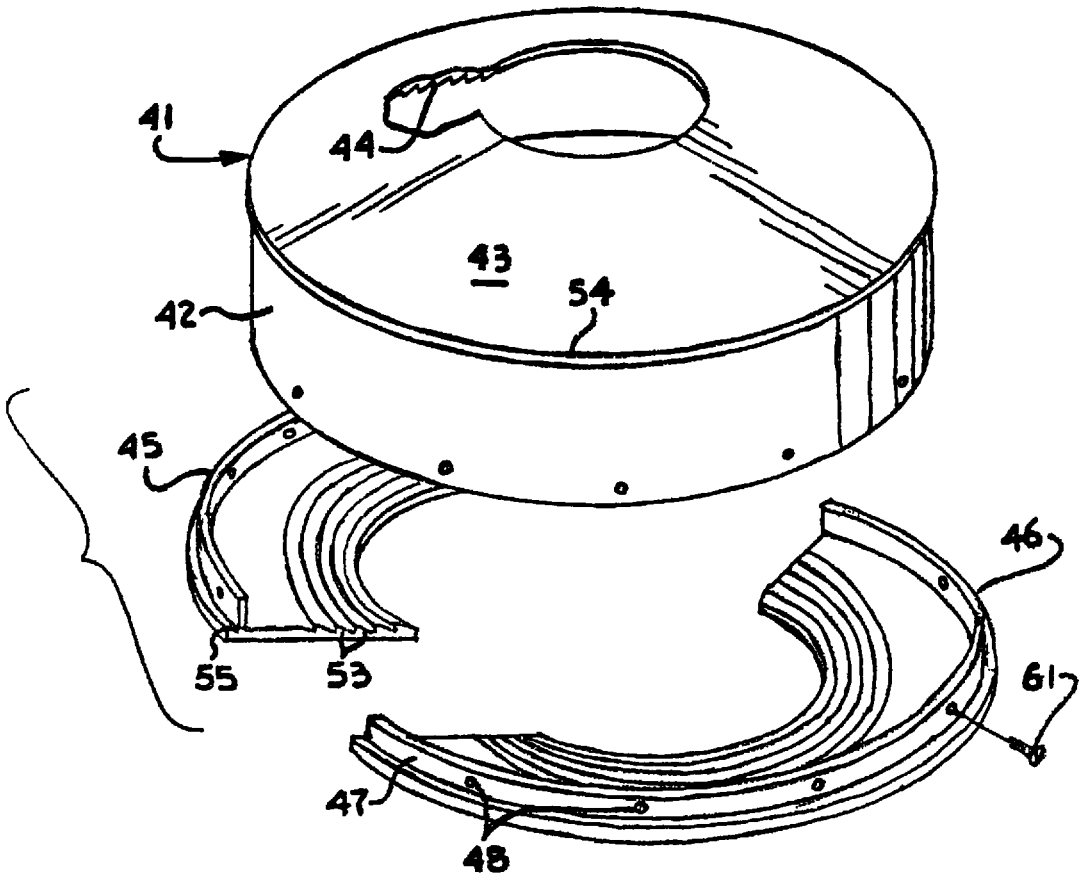
FIG. 4 is an enlarged exploded, perspective view of a second embodiment of the inventive reflective collar prior to installation on the fire hydrant.

FIGS. 3 and 4 show a second embodiment of collar attachment, generally indicated at 1*b*. The collar attachment 1*b* is similar in appearance to the first embodiment when installed on a fire hydrant such as the hydrant 36 in FIG. 3. The collar attachment 1*b* has a three piece construction with a cap 41 formed by a cylindrical perimeter wall 42 and an integrally formed top 43. The top 43 is formed as a circular inward extension of the perimeter wall 42 and is constructed with a number of circular stair-stepped indentations 44 of incrementally decreasing radii with the smallest circular indentation ending in a circular opening of a minimum radius. The cap top 43 can thus be adjusted in inner radius by severing the circular extensions at any of the indentations 44 so that the collar cap 41 can be adjusted to fit over any circular fire hydrant design. A pair of semi-circular extensions 45 and 46 are designed to be screwed into the inside periphery of the bottom of the cylindrical wall 42 of the cap once it is placed over a fire hydrant such as the hydrant 2. Each of the semi-circular extensions 45 and 46 includes a vertical perimeter lip 47 with a plurality of threaded receptacles 48 positioned to receive respective screws 51 inserted through corresponding bores 52 in the sides of the cylindrical wall 42 to hold the extensions 45 and 46 in place inside the wall 42. Each semi-circular extension 45 and 46 also includes a plurality of semi-circular stair-stepped indentations 53 of incrementally decreasing radii with the smallest circular indentation 53 ending in a semi-circular opening of a minimum radius. Each of the semi-circular extensions 45 and 46 can thus also be adjusted in inner radius by severing them at any of the indentations 53 so that the bottom of the collar attachment 1*b* can be adjusted to fit the particular fire hydrant design. The cap top 43 of the collar attachment 1*b* is sloped from inside to outside to prevent moisture from accumulating. The collar attachment 1*b* includes upper and lower flanges 54 (on the cap perimeter wall 42) and 55 (on the semi-circular extensions 45 and 46) separated by a display area 56 which accommodates a web of color coded, highly reflective tape such as one of the tape designs 3*a*–3*d*.

Figure 5:
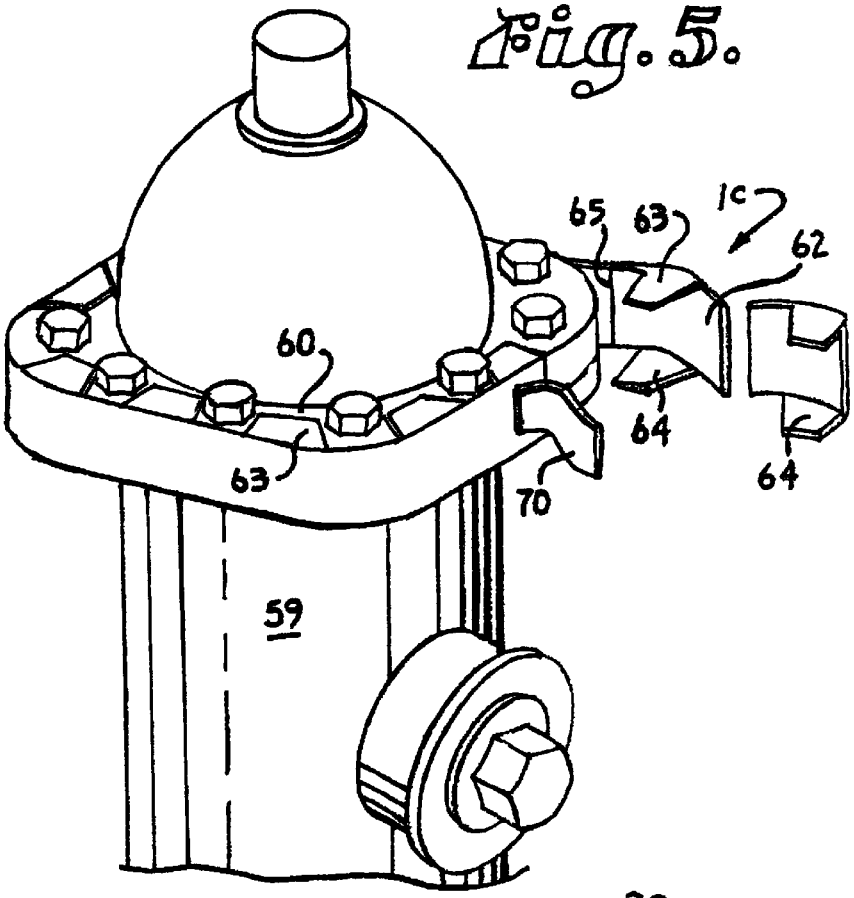
FIG. 5 is a perspective view of a fire hydrant equipped with a reflective collar attachment in accordance with a third embodiment of the present invention.
Figure 6A:
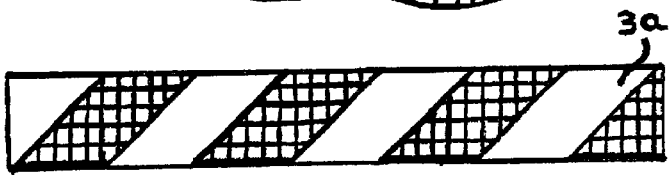
FIGS. 6*a*–6*d* are representative samples of various color-coded patterns of reflective webs which can be used on the reflective collar attachment.
Figure 6B:
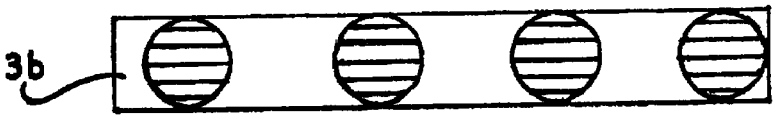
Figure 6C:
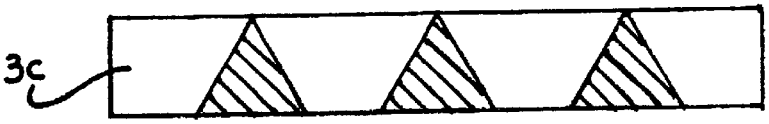
Figure 6D:
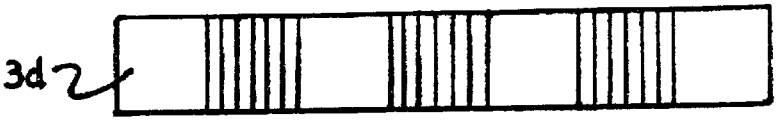

FIG. 5 illustrates a third embodiment of collar attachment, generally indicated at 1*c*. The collar attachment 1*c* is designed to fit hydrants of any shape, including a hydrant 59 with a substantially square flange 60. The collar attachment 1*c* includes a continuous, resilient strip of plastic 62 with a plurality of upper and lower tooth-like projections 63 and 64, respectively extending outward from the plastic strip 62. The strip 62 and teeth 63 and 64 create a channel with a width sized to encompass the vertical dimension of a typical connecting flange, such as the connecting flange 60 of the hydrant 59. Between each pair of teeth 63, 64 the plastic strip 62 has a vertical indentation 65 which forms an interior score line such that the strip 62 can be easily severed at the indentations 65, as shown in FIG. 5, to form any desired length. The strip 62 is then wrapped around a fire hydrant flange, such as the flange 60, with the teeth 63, 64 extending inward over the top and bottom, respectively, of the fire hydrant flange 60. Opposing ends of the strip 62 are then overlapped and taped into place with a length of "lock" tape 70. An outside perimeter surface 71 of the strip 62 forms a display area which receives a web of color coded, highly reflective tape, such as one of the tape designs 3*a*–3*d* to form a highly reflective, color coded fire hydrant collar.

The reflective collar attachments 1*a*, 1*b* or 1*c* provide a convenient and highly effective and visible adjunct to fire hydrants, such as the fire hydrants 2 or 59, which allow them to be much more readily seen at night and in low light conditions. The collar attachments 1*a*–1*c* also provide an efficient way to change the color coding of the fire hydrant to match the NFPA coding scheme for that particular hydrant.

It is to be understood that while certain forms of the present invention have been illustrated and described herein, it is not to be limited to the specific forms or arrangement of parts described and shown. For example, the patterns shown on tape designs 3*a*–3*d* are exemplary only and any pattern which prominently displays a color which matches the NFPA color code would suffice. While the collar attachments 1*a* and 1*b* have been illustrated as generally circular, the exterior portion can be any desired shape, including square, rectangular, etc. as long as the inner radius is generally circular. The pins and receptacles used to align and attach the two halves of the collar attachment 1*a* together could be replaced with a spring clamp, a plurality of screws, a band which encircles both halves which band can be selectively tightened, or any other suitable arrangement. Instead of separable halves, the collar 1*a* could have two halves hinged together on one side in a clam shell arrangement with the opposite sides of the two halves being connectable to form a complete collar. The collar attachment 1*b* can have extensions 45 and 46 which are snap fit to the perimeter wall 42 instead of screwed thereto. The collar attachment 1c can have teeth 63, 64 of any desired shape or size and the strip 62 can have any desired shape or width. Other variations will occur to those of ordinary skill in the art.

We claim:

1. A collar attachment for a fire hydrant, comprising:

a. a collar structure which is adjustable in interior diameter to circumscribe a peripheral surface of the fire hydrant, said collar structure comprising:

i. first and second collar halves, each of which has a semicircular inner radius, said first collar half mating with said second collar half to form said collar attachment;

b. a securing means for securing said collar structure to the fire hydrant, said securing means for securing around the fire hydrant;

c. a display area formed on an exterior of said collar structure;

d. a reflective web removably positionable in said display area; wherein e. said semicircular inner radius of each of said first and second collar halves is formed by at least one semi-circular extension, each said extension being constructed with a number of semi-circular indentations of incrementally decreasing radii with the smallest circular indentation ending in a minimum semi-circular radius such that an inner diameter of each of said first and second collar halves can be varied by severing said extension at respective one of said semi-circular indentations.

2. A collar attachment as in claim 1, wherein the at least one semi-circular extension for each of said first and second collar halves comprises an upper semi-circular extension and a lower semi-circular extension.

3. A collar attachment as in claim 2, wherein each of said upper extensions angles upward from an outer to an inner diameter.

4. A collar attachment as in claim 1, and further comprising:

a. a first flange extending about the outer periphery of each of said collar halves; and b. a second flange extending about the outer periphery of each of said collar halves, said display area being formed between said first and second flanges around the periphery of said collar when said collar halves are secured together.

5. A collar attachment for a fire hydrant, comprising:

a. a collar structure which is sized to circumscribe a peripheral surface of the fire hydrant, said collar structure comprising:

i. a cap formed by a cylindrical perimeter wall and a top including an integral circular extension which is open in the center to form a circular opening;

ii. a pair of semi-circular extensions attachable to an inside periphery of the cylindrical perimeter wall of the cap to form a bottom surface of said collar attachment, each of said semi-circular extensions including an inner semi-circular opening;

b. a display area formed on an exterior of said cap cylindrical perimeter wall;

c. a reflective web removably positionable in said display area;

d. said integral circular extension being constructed with a number of circular stair-stepped indentations of incrementally decreasing radii such that the circular opening can be adjusted in diameter by severing the integral circular extension at any of the indentations.

6. A collar attachment as in claim 5, wherein each of said semi-circular extensions comprises a number of semi-circular stair-stepped indentations of incrementally increasing radii so that the inner semi-circular openings can be adjusted to fit a particular fire hydrant design by severing said extensions at any of the indentations.

7. A collar attachment for a fire hydrant, comprising:

a. a collar structure which is sized to circumscribe a peripheral surface of a fire hydrant, said collar structure comprising a continuous, resilient strip with a plurality of upper and lower tooth-like projections extending outward from the plastic strip, said strip and said upper and lower projections forming a channel with a width sized to encompass a vertical dimension of a connecting flange of a fire hydrant;

b. a length of tape which secures one end of said strip to an opposite end of said strip around the connecting flange;

c. a display area formed on a side of said strip opposite said upper and lower projections; and d. a reflective web removably positionable in said display area.

8. A collar attachment as in claim 7, wherein said strip further comprises a vertical indentation between each successive pair of said upper and lower projections which forms an interior score line such that the strip can be easily severed at the indentations to form any desired length.

* * * * *